US006036605A

United States Patent [19]

Tseng

[11] Patent Number: 6,036,605

[45] Date of Patent: Mar. 14, 2000

[54] SWING ASSEMBLY

[75] Inventor: Chuen-Jong Tseng, Chiayi Hsien, Taiwan

[73] Assignee: Shin Yen Enterprise Co., Ltd., Chiayi Hsien, Taiwan

[21] Appl. No.: 09/358,173

[22] Filed: Jul. 20, 1999

[51] Int. Cl.[7] ..... A63G 9/00

[52] U.S. Cl. ..... 472/118; 472/125; 297/281

[58] Field of Search ..... 472/118, 120, 472/125; 297/273, 281, 282, 354.12; 5/124, 127–129; 403/361, 292, 296, 306

[56] References Cited

U.S. PATENT DOCUMENTS

| | | | |
|---|---|---|---|
| 2,547,891 | 4/1951 | Smith | 472/125 X |
| 4,917,378 | 4/1990 | Girecky et al. | 472/125 |
| 5,564,987 | 10/1996 | Ayrolles | 472/118 |
| 5,803,818 | 9/1998 | Tseng | 472/118 |
| 5,876,289 | 3/1999 | Liu | 472/118 |
| 5,957,780 | 9/1999 | Grazioli | 472/118 |

*Primary Examiner*—Kien T. Nguyen

*Attorney, Agent, or Firm*—Ladas & Parry

[57] ABSTRACT

A swing assembly includes a support frame, a pair of linking units, a seat unit, and a pair of pivot connecting units. The support frame has upright left and right frame portions adapted to be supported on a ground surface, and a horizontal bar interconnecting the left and right frame portions. The linking units are disposed between the left and right frame portions. Each of the linking units has an upper end connected pivotally to the horizontal bar, and a lower end. The seat unit is disposed between the linking units, and has two lateral arms proximate to the linking units. The pivot connecting units connect the lateral arms of the seat unit to the linking units, respectively. Each of the pivot connecting units includes an internally threaded tubular projection which projects from a respective one of the lateral arms of the seat unit toward an adjacent one of the linking units, a pivot hole formed in the adjacent one of the linking units, and a threaded rod having a first end which engages threadedly the tubular projection and a second end which extends through the pivot hole for mounting pivotally on the adjacent one of the linking units at the pivot hole such that a clearance is formed between the respective lateral arm and the adjacent linking unit.

2 Claims, 4 Drawing Sheets

SWING ASSEMBLY

BACKGROUND OF THE INVENTION

1. Field of the Invention

The invention relates to a swing assembly, more particularly to a swing assembly which can prevent the fingers of the user from being hurt when the swing assembly is in use.

2. Description of the Related Art

Referring to FIG. 1, a conventional swing 1 is shown to include a support frame 11 with left and right frame portions 111 and a horizontal bar 10 interconnecting top ends of the left and right frame portions 111, a seat unit 12 disposed between the left and right frame portions 11 and below the horizontal bar 10, and a pair of linking units 14 extending downwardly from the horizontal bar 10 and connected to a pair of lateral arms 123 of the seat unit 12. Each of the linking units 14 includes a front linking rod 141 and a rear linking rod 142 which have upper ends connected pivotally to the horizontal bar 10, and lower ends connected pivotally to a respective one of the lateral arms 123 such that the seat unit 12 is swingable forwardly and rearwardly relative to the support frame 11. As shown in FIG. 2, the lower end of each of the front and rear linking rods 141, 142 is connected to the respective lateral arm 123 of the seat unit 12 by means of a pivot shaft 15 which extends through aligned pivot holes 124, 131 in the lateral arm 123 and the linking rod 141(142). Since the linking rod 141 and the lateral arm 123 are disposed immediately adjacent to each other, and are movable relative to each other during swinging movement of the seat unit 12, it is possible that the user's fingers will be caught between the linking rod 141 and the lateral arm 123 when the user rests his hand on the lateral arm 123.

SUMMARY OF THE INVENTION

Therefore, the main object of the present invention is to provide a swing assembly which can ensure the safety of the user during use.

Accordingly, the swing assembly of the present invention includes a support frame, a pair of linking units, a seat unit, and a pair of pivot connecting units. The support frame has upright left and right frame portions adapted to be supported on a ground surface, and a horizontal bar interconnecting the left and right frame portions and vertically spaced apart from the ground surface. The linking units are disposed between the left and right frame portions and are horizontally spaced apart from each other. Each of the linking units has an upper end connected pivotally to the horizontal bar, and a lower end. The seat unit is disposed between the linking units, and has two lateral arms proximate to the linking units. The pivot connecting units connect the lateral arms of the seat unit to the linking units, respectively. Each of the pivot connecting units includes an internally threaded tubular projection which projects from a respective one of the lateral arms of the seat unit toward an adjacent one of the linking units, a pivot hole formed in the adjacent one of the linking units, and a threaded rod having a first end which engages threadedly the tubular projection and a second end which extends through the pivot hole for mounting pivotally on the adjacent one of the linking units at the pivot hole such that a clearance is formed between the respective one of the lateral arms of the seat unit and the adjacent one of the linking units.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
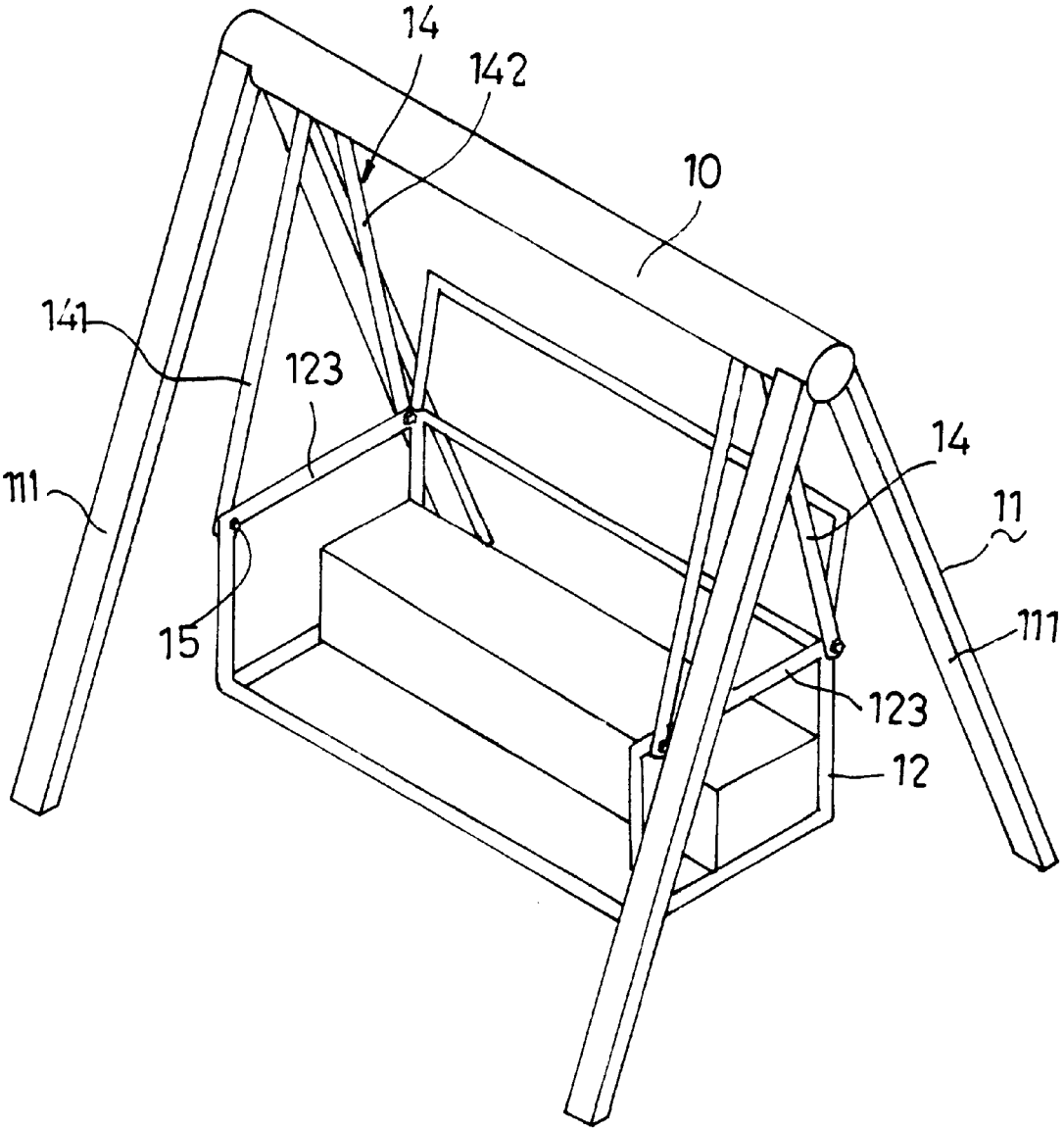
FIG. 1 PRIOR ART
FIG. 1 is a perspective view of a conventional swing.
Figure 2:
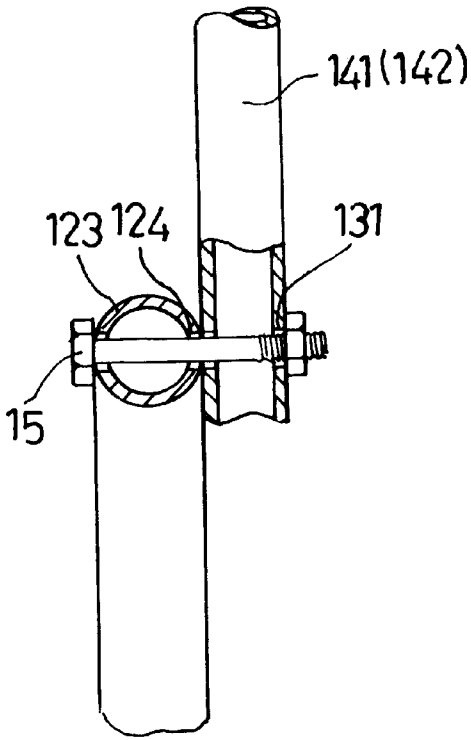
FIG. 2 PRIOR ART
FIG. 2 is an enlarged fragmentary sectional view illustrating the connection between a linking unit and a seat unit of the conventional swing.
Figure 3:
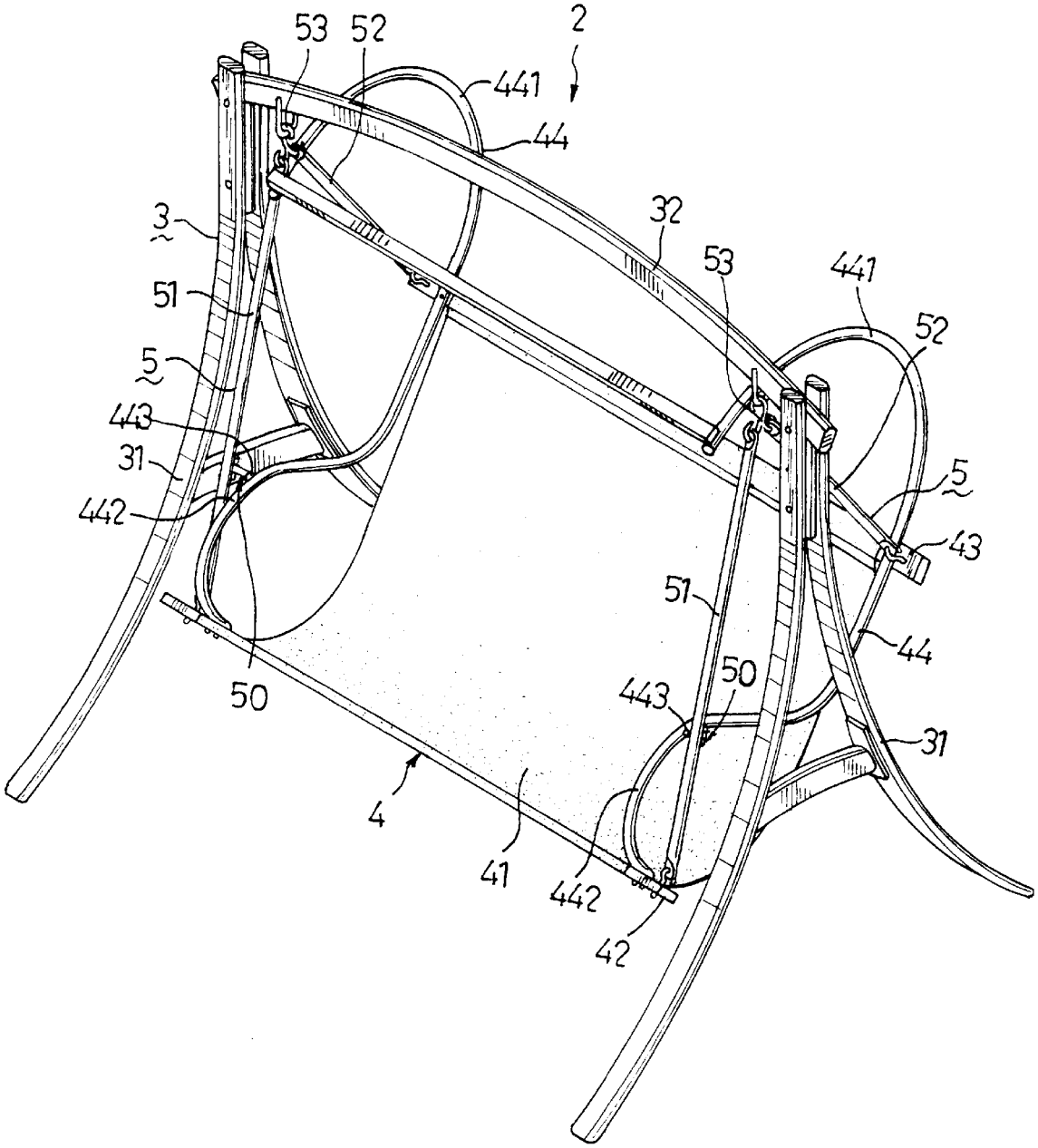
FIG. 3 is a perspective view of a preferred embodiment of a swing assembly according to the present invention.

Referring to FIG. 3, the swing assembly 2 of the preferred embodiment according to the present invention is shown to include a support frame 3, a seat unit 4, a pair of linking units 5, and a pair of pivot connecting units 50.

The support frame 3 includes left and right frame portions 31 which are adapted to be supported on a ground surface, and a horizontal bar 32 interconnecting top ends of the frame portions 31 such that the horizontal bar 32 is vertically spaced apart from the ground surface. Each of the left and right frame portions 31 has an "A" shaped formation with a wider bottom end and a narrower top end. A swinging space is defined among the left and right frame portions 31 and the horizontal bar 32. The seat unit 4 is disposed in the swinging space, and is suspended on the horizontal bar 32 by means of the pair of linking units 5, which are horizontally spaced apart from each other. The seat unit 4 includes a horizontal front connecting rail 42, a horizontal rear connecting rail 43 disposed at a level higher than the front connecting rail 42, apiece of cloth 41 mounted on the front and rear rails 42, 43 so as to form a seat, and a pair of lateral arms 44 which are proximate to the left and right frame portions 31 and which interconnect end portions of the front and rear connecting rails 42, 43. Each of the lateral arms 44 has a curved upper section 441 secured to the rear connecting rail 43, and a lower section 442 with a lower end secured to the front connecting rail 42. The lower section 442 of each of the lateral arms 44 forms an armrest portion to permit the arm of the user to rest thereon when the user is seated on the seat. Each of the linking units 5 is disposed between a respective one of the lateral arms 44 of the seat unit 4 and an adjacent one of the left and right frame portions 31 of the support frame 3. Each of the linking units 5 includes a front linking rod 51 and a rear linking rod 52. The front linking rod 51 has an upper end connected pivotally to the horizontal bar 32 by means of a three-ended hook member 53, and a lower end connected pivotally to the front connecting rail 42 of the seat unit 4. The rear linking rod 52 has an upper end connected pivotally to the horizontal bar 32 by means of the hook member 53, and a lower end connected pivotally to the rear connecting rail 43 of the seat unit 4.

Figure 5:
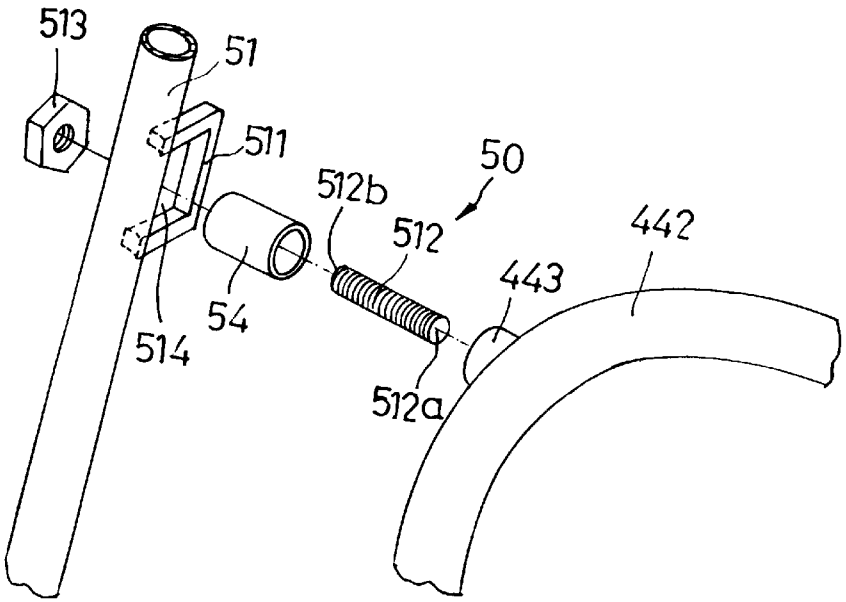
FIG. 5 is a fragmentary exploded perspective view illustrating the pivot connecting unit of FIG. 4.
Figure 4:
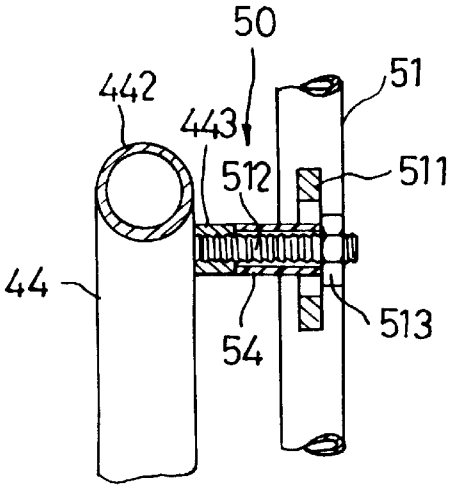
FIG. 4 is an enlarged fragmentary sectional view illustrating a pivot connecting unit for connecting a linking unit with a seat unit of the swing assembly of the preferred embodiment.

Referring to FIGS. 4 and 5, each of the pivot connecting units 50 includes an internally threaded tubular projection 443, a threaded rod 512, a U-shaped member 511, a nut 513, and a covering sleeve 54. The tubular projection 443 projects horizontally from the lower section 442 of a respective one of the lateral arms 44 of the seat unit 4 toward an adjacent front linking rod 51. The U-shaped member 511 has opposed ends secured on the adjacent front linking rod 51 to confine a pivot hole 514. The threaded rod 512 has a first end

512*a* extending into and engaging threadedly the tubular projection 443, and a second end 512*b* which extends through the pivot hole 514 and which engages the nut 513 for mounting pivotally on the adjacent front linking rod 51 at the pivot hole 514. The covering sleeve 54 is sleeved on the threaded rod 512, and is disposed adjacent to the tubular projection 443. The tubular projection 443 is designed to have a sufficient length such that a sufficiently wide clearance can be kept between the lateral rod 44 and the adjacent front linking rod 51 to prevent the fingers of the user from being caught and hurt by the lateral rod 44 and the front linking rod 51.

Accordingly, with the provision of the tubular projection 443 which projects from a respective one of the lateral rods 44 of the seat unit 4 toward an adjacent one of the front linking rods 51 of the linking units 5, a sufficiently wide clearance can be kept at the connection between the lateral rod 44 and the adjacent front linking rod 51 so as to prevent injury to the user during swinging of the seat unit 4 forwardly and rearwardly relative to the support frame 3. The objective of this invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing assembly comprising:

a support frame having upright left and right frame portions adapted to be supported on a ground surface, and a horizontal bar interconnecting said left and right frame portions and vertically spaced apart from the ground surface;

a pair of linking units disposed between said left and right frame portions and horizontally spaced apart from each other, each of said linking units having an upper end connected pivotally to said horizontal bar, and a lower end;

a seat unit disposed between said linking units, said seat unit having two lateral arms proximate to said linking units;

a pair of pivot connecting units for connecting said lateral arms of said seat unit to said linking units, respectively, each of said pivot connecting units including an internally threaded tubular projection which projects from a respective one of said lateral arms of said seat unit toward an adjacent one of said linking units, a pivot hole formed in the adjacent one of said linking units, and a threaded rod having a first end which engages threadedly said tubular projection and a second end which extends through said pivot hole for mounting pivotally on the adjacent one of said linking units at said pivot hole such that a clearance is formed between the respective one of said lateral arms of said seat unit and the adjacent one of said linking units.

2. The swing assembly according to claim 1, wherein each of said pivot connecting units further includes a covering sleeve which is sleeved on said threaded rod.

* * * * *